US005373310A

United States Patent [19]

Ichimura et al.

[11] Patent Number: 5,373,310

[45] Date of Patent: Dec. 13, 1994

[54] DISPLAY CONTROLLER FOR OUTPUTTING DISPLAY SEGMENT SIGNALS

[75] Inventors: Teruo Ichimura; Kazuhiko Suzuki; Junichi Ishimoto, all of Kanagawa, Japan

[73] Assignee: NEC Corporation, Tokyo, Japan

[21] Appl. No.: 874,759

[22] Filed: Apr. 27, 1992

[30] Foreign Application Priority Data

Apr. 25, 1991 [JP] Japan ..... 3-125576
Apr. 25, 1991 [JP] Japan ..... 3-125577

[51] Int. Cl.[5] ..... G09G 1/02

[52] U.S. Cl. ..... 365/197; 345/33

[58] Field of Search ..... 340/800, 801, 781, 756, 340/765, 784; 313/495, 496, 497; 345/197, 198, 185, 205, 33, 34, 55, , 50, 87

[56] References Cited

U.S. PATENT DOCUMENTS 3,879,723 4/1975 Hornung ..... 340/336
4,113,361 9/1978 Nakano ..... 340/800
4,149,151 4/1979 Nagae et al. ..... 340/765
4,180,813 12/1979 Yoneda ..... 340/800
4,186,393 1/1980 Leventer ..... 340/800
4,223,526 9/1980 Tanaka et al. ..... 340/765
4,671,616 6/1987 Aoki et al. ..... 340/784
4,899,140 2/1990 Ito et al. ..... 340/756
4,939,529 7/1990 Kanayama et al. ..... 346/108

OTHER PUBLICATIONS

"IMS G300 Colour Video Controller" immos, Preliminary Data pp. 73–75, 85, 93–95 Nov. 1988.

*Primary Examiner*—Ulysses Weldon
*Assistant Examiner*—Doon Chow
*Attorney, Agent, or Firm*—Whitham, Curtis, Whitham & McGinn

[57] ABSTRACT

Display data is read out from a display memory in parallel, and is temporarily held in a first shift register located near to the display memory. The display data is serially read out and transferred from the first shift register in one bit unit to a second shift register located near to an display data latch, in synchronism with a shift clock signal outputted from a shift clock controlling circuit. The display data held in the second shift register is outputted in parallel to the display data latch in accordance with a display data read signal. Thus, it is possible to reduce the increase of the number of the wiring lines extending from the display memory to the display data latch, as well as the increase of the chip area, both of which would be caused by the increase of the display segments. It is also possible to reduce the limitations related to the arrangement of the interior of the microcomputer.

3 Claims, 13 Drawing Sheets

OUTPUT TERMINALS
501-1
501-2
501-3
ADDRESS GENERATING CIRCUIT 510
DISPLAY DATA READ SIGNAL 508
SHIFT REGISTER A 121
CLOCK SIGNAL 124
SHIFT CLOCK MASK SIGNAL 130
SHIFT CLOCK SIGNAL 127
CORRECTED SHIFT CLOCK SIGNAL 128
SHIFT REGISTER B 123
DISPLAY DATA LATCH 506
OUTPUT TERMINAL 503
ADDRESS FOR 501-2
ADDRESS FOR 501-3
DISPLAY DATA FOR 501-2
DISPLAY DATA FOR 501-3
00
00
00
DISPLAY DATA FOR 501-1
DISPLAY DATA FOR 501-2
DISPLAY DATA FOR 501-1
DISPLAY DATA FOR 501-2

DISPLAY CONTROLLER FOR OUTPUTTING DISPLAY SEGMENT SIGNALS

BACKGROUND OF THE INVENTION

1. Field of the Invention

The present invention relates to a display controller contained in a microcomputer and including a display driver, and more specifically to a transfer of display data from a display memory to a display segment signal output terminals in such a display controller.

2. Description of Related Art

In conventional display controllers for fluorescent character display tubes and/or liquid crystal displays, a count clock is counted by a timing counter, and a count value of the timing counter is supplied to an address generator, which supplies a display memory with an address for display data of a character to be displayed next. Thus, display data of a character is read out from the display memory and supplied to a display data latch in parallel. In the case of the fluorescent character display tube, the display data latch outputs the latched display data through an output buffer to display segment signal output terminals, which are connected to a fluorescent character display tube. In addition, the count value of the timing counter is also supplied to a display timing decoder, which has an output connected through another output buffer to display digit signal output terminals, which are also connected to the fluorescent character display tube. In the case of the liquid crystal display (LCD), the display data latch outputs the latched display data through a segment driver to display segment signal output terminals, which are connected to the LCD display. In addition, the count value of the timing counter is also supplied to a common driver having an output connected to common driver output terminals, which are also connected to the LCD display.

As mentioned above, the conventional display controller is such that the display data is transferred from the display memory to the display data latch in parallel. Therefore, the number of wiring lines extending from the display memory to the display data latch has to be the same as the number of the display segment output terminals. Namely, the number of wiring lines for transferring the display data from the display memory to the display data latch in parallel is increased with the number of the display segments. As a result, the chip area of a microcomputer including the display controller inevitably increases. Further, in the arrangement of the inside of the microcomputer, there occurs a restriction that the display memory and the display segment output terminals should be disposed in the neighborhood to each other.

SUMMARY OF THE INVENTION

Accordingly, it is an object of the present invention to provide a display controller which has overcome the above mentioned defect of the conventional one.

Another object of the present invention is to provide a display controller capable of suppressing the increase of the number of the wiring lines extending from the display memory to the display data latch, as well as the increase of the chip area, both of which would be caused by the increase of the display segments.

The above and other objects of the present invention are achieved in accordance with the present invention by a display controller comprising a display memory for storing display data, a first shift register of a plurality of bits for holding display data read out from the display memory in units of a given bit length, and for serially outputting the held display data in units of one bit, a second shift register of a plurality of bits for storing the display data outputted from the first shift register and for outputting the stored display data in parallel, a shift clock controlling circuit for generating a shift clock signal to the first and second shift registers to cause them to shift-operate, and a display data latch for latching the display data outputted from the second shift register in parallel and for outputting the latched display data to a plurality of display segment signal output terminals for outputting the display data to the exterior.

According to another aspect of the present invention, there is provided a display controller comprising a display memory for storing display data, a digit-setting circuit which can be set with a display digit number, a display timing decoder for outputting a display digit signal, a first shift register of a plurality of bits for holding display data read out from the display memory, and for serially outputting the held display data, a second shift register of a plurality of bits for serially storing the display data outputted from the first shift register and for outputting the stored display data in parallel, a shift clock controlling circuit for generating a shift clock signal to be supplied to the first and second shift registers, a shift correcting circuit receiving the shift clock signal and a value of the digit-setting circuit for controlling the shift clock signal supplied to the first and second shift registers to cause them to shift-operate, a display data latch for latching the display data outputted from the second shift register in parallel and for outputting the latched display data, and a plurality of display segment and digit signal output terminals receiving an output of the display timing decoder and the latched display data outputted from the display data latch for outputting the received data to the exterior.

With the above mentioned arrangement, the first shift register holds display data read out from the display memory, in units of a given bit length, and serially supplies the held display data in units of one bit, in synchronism with the shift clock. The second shift register serially receives the display data outputted from the first shift register, in synchronism with the shift clock. The display data stored in the second shift register is outputted to the display latch in parallel. The only wiring lines required between and for the first and second shift registers are a serial data line for serially transferring the display data from the first shift register to the the second shift register, and a serial clock line for supplying the serial clock to the first and second shift registers. Therefore, if the first shift register is located near to the display memory and if the second shift register is located near to the display data latch, the number of wiring lines extending between the display memory and the display data latch can be minimized, regardless of the increase of the display segment number. Accordingly, the chip area of a microcomputer including the display controller can be decreased. Further, in the arrangement of the inside of the microcomputer, it is possible to relax a restriction that the display memory and the display segment output terminals should be disposed in the neighborhood to each other.

The above and other objects, features and advantages of the present invention will be apparent from the following description of preferred embodiments of the invention with reference to the accompanying drawings.

DESCRIPTION OF THE PREFERRED EMBODIMENTS

Figure 1:
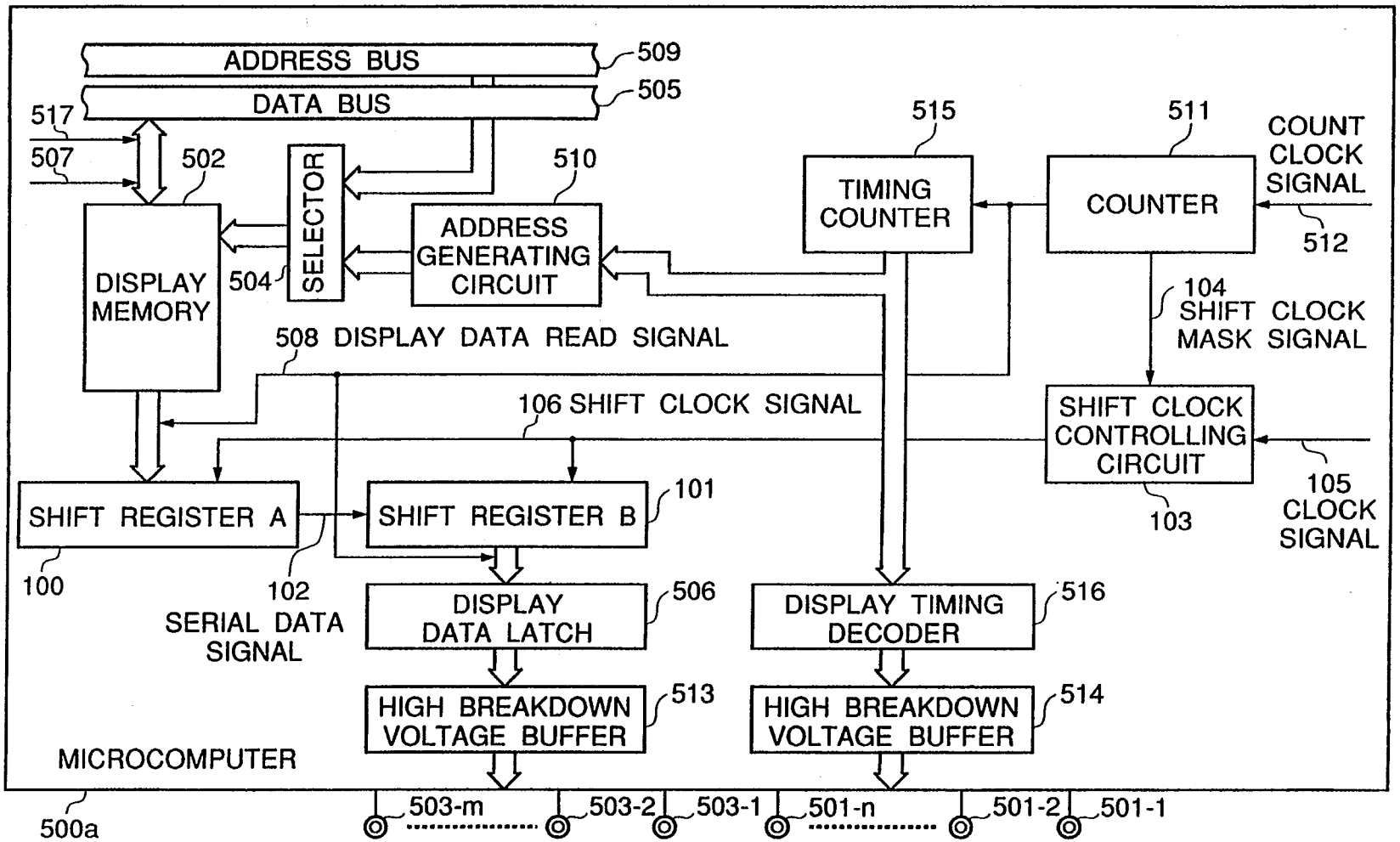
FIG. 1 is a block diagram illustrating a first embodiment of the display controller in accordance with the present invention.

FIG. 1 is a block diagram of a first embodiment illustrating a fluorescent display tube controller.

A microcomputer 500*a* including a fluorescent display tube controller comprises a display memory 502 for storing display data, a plurality of display segment signal output terminals 503 (503-1 to 503-*m*) for outputting a signal controlling the display panel to the exterior and a display data latch 506 for latching the display data read out from the display memory 502 and outputting it to the display segment signal output terminals 503. According to the first embodiment, the microcomputer 500*a* comprises a first shift register A 100 for receiving and storing in parallel the display data read out from the display memory 502 in units of a determined bit length, and for serially outputting it in units of one bit, a second shift register B 101 of a plurality of bits for receiving and storing the display data serially outputted from the shift register A 100 and for outputting it to the display data latch 506, and a shift clock controlling circuit 103 which receives a shift clock mask signal 104 and a clock signal 105 and outputs a shift clock signal 106 to the first and second shift registers A 100 and B 101 in order to cause the content of the first and second shift registers A 100 and B 101 to shift.

In FIG. 1, a plurality of display digit signal output terminals 501 (501-1 to 501-n), a selector 504, a data bus 505, a memory write signal 507, a display data read signal 508, an address bus 509, an address generating circuit 510, a counter 511, a count clock signal 512, high breakdown voltage buffers 513 and 514 for supplying a high driving voltage to an associated fluorescent display tube, a timing counter 515, a display timing decoder 516 and a memory read signal 517 are shown.

An address of the display memory 502 is selected by an output of the selector 504 and it is possible to read out or write through the data bus 505. It is possible to read out the display data latch 506, too. The reading or writing between the display memory 502 and the data bus 505 is executed by the memory read signal 517 or the memory write signal 507, and the reading from the display memory 502 to be supplied to the display date latch 506 is executed by the display date read signal 508.

The selector 504 comprises the time-division switching means for selecting either the memory address between the address from an address bus 509 or an address outputted by the address generating circuit 510. The address from the address bus 509 is selected for reading or writing between the display memory 502 and the data bus 505. On the other hand, the address outputted from the address generating circuit 510 is selected for reading from the display memory 502 to be supplied to the display data latch 506.

The counter 511 executes the counting function on the basis of the count clock signal 512 and outputs an overflow of the counter as the display data read signal 508 to the timing counter 515. The display data read signal 508 becomes at "H" (high) level at the start of the respective display digit signal output. The timing counter 515 executes the counting function on the basis of the display data read signal 508 outputted from the counter 511 and sends the count value to the display timing decoder 516 and the address generating circuit 510.

The display timing decoder 516 decodes the count value outputted from the timing counter 515, and generates a plurality of display digit signals, which are successively activated at "H" in the order and which are outputted from the plurality of display digit signal output terminals 501 through the high breakdown voltage buffer 514. The address generating circuit 510 outputs an address to be updated on the basis of the count up of the timing counter 515 and generates an address with respect to the display data corresponding to each display digit signal output. When the display data read signal 508 is at "H" level, the display data latch 506 latches the data of the plurality of bits in parallel from the shift register B 101, and simultaneously sends its content to the plurality of display segment signal output terminals 503 through the high breakdown voltage buffer 513.

Next, the operation of the first embodiment will be described.

Figure 2:
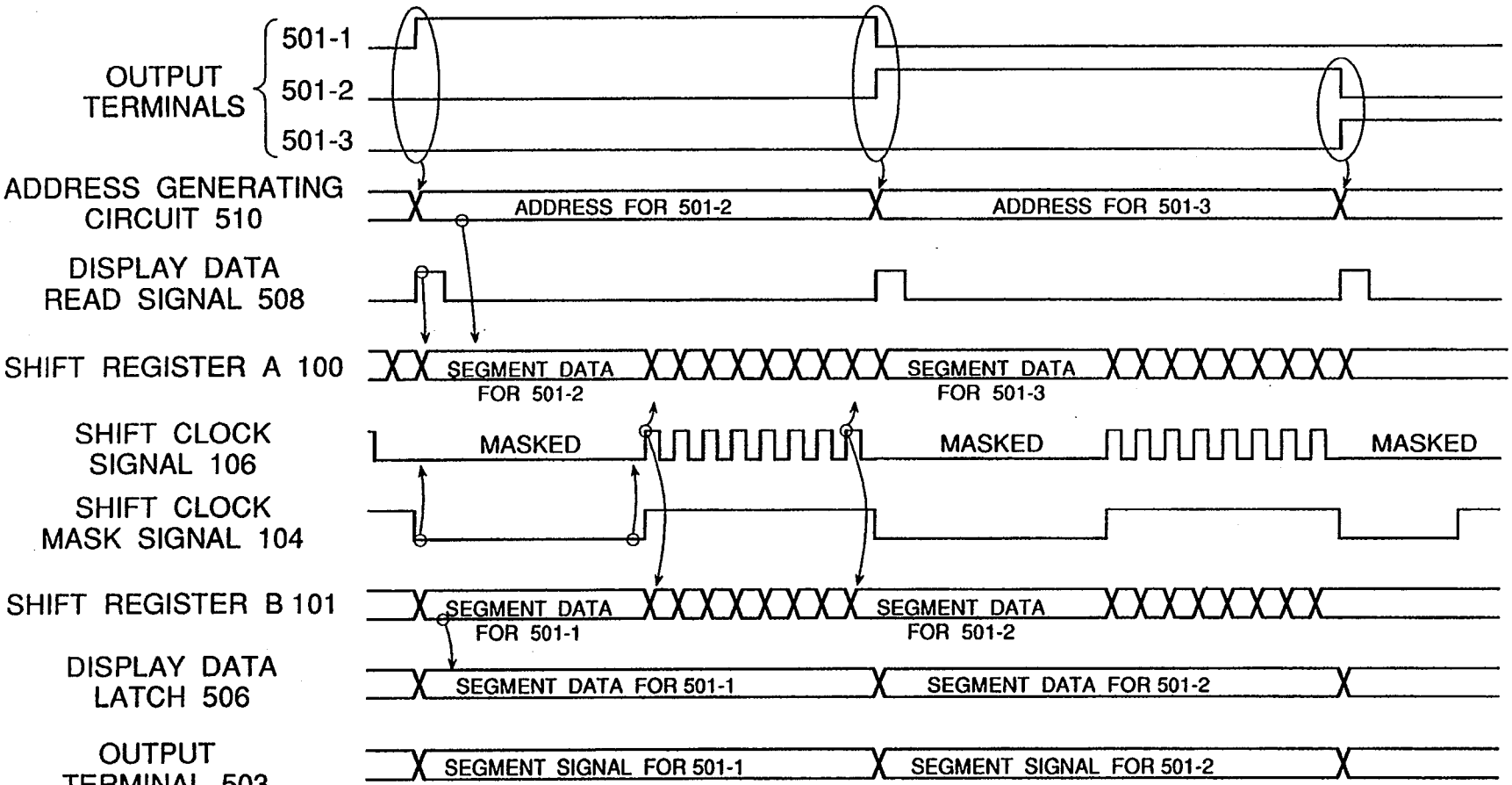
FIG. 2 is a timing chart of the display controller with shown in FIG. 1.

The display timing decoder 516 outputs "H" activated signals through the display digit signal output terminals 501 in order of 501-1, 501-2 and 501-3 on the basis of the count up of the display digit executed by the timing counter 515. In FIG. 2, the falling of the output terminal 501-1 and the rising of the output terminal 501-2 are executed at the same timing, and the falling of the output terminal 501-2 and the rising of the output terminal 501-3 are executed at the same timing. However, an asynchronous control is executed in order to prevent a leaked-light emission of the fluorescent display tube.

The address generating circuit 510 generates an address of the display memory 502 corresponding to the activated display digit signal. Thus, when the output terminal 501-2 is active, the circuit generates an address of the display memory 502 where the display data to be outputted when the output terminal 501-2 is active is stored.

In the first embodiment, the reading or writing with the data bus 505 and the reading of the display data latch 506 are executed in a time-division method for the access to the display memory 502. In a variant, the display memory 502 can be substituted by a dual port RAM.

In the first embodiment, assume that the display segment signal output terminals 503 are eight (m=8) for simplicity of the explanation.

The shift clock controlling circuit 103 outputs the clock signal 105 as shift clock signal 106 and masks the shift clock signal at "L" (low) level for a given period on the basis of a shift clock mask signal 104.

The shift register A 100 receives and stores display data stored in the display memory 502 in byte units on the basis of the display data read signal 508, and executes the serial transfer, one bit by one bit, on the basis of the shift clock signal 106 outputted from the shift clock controlling circuit 103. The shift register B 101 is a register having the same bit length as that of the shift register A 100 and receives the display data transferred serially as serial data signal 102 from the shift register A 100 on the basis of the shift clock signal 106 outputted from the shift clock signal 103. After the serial transfer, its content was outputted to the display data latch 506 on the basis of the display data read signal 508, and the content latched in the display latch 506 is simultaneously outputted to a plurality of display segment signal output terminals 503 through the high breakdown voltage buffer 513.

The display output timing of the first embodiment will be described with reference to FIG. 2. In FIG. 2, the output terminals 501-1, 501-2 and 501-3 are the outputs of the display digit signal output terminal 501. This display digit signal output terminal 501 successively outputs "H" active signals from the output terminals in the order of 501-1, 501-2 and 501-3. The timing counter 515 counts up by the number of display digits.

An address which the address generating circuit 510 generates is updated with the count up of the timing counter 515. However, the address generated in the first embodiment is not that of the display memory 502 storing the display data corresponding to the activated digit signal output as in a conventional example. It generates an address storing the display data corresponding to the next display digit signal output. Thus, when the output terminal 501-3 is active, it generates an address of the display memory 502 in which the display data to be outputted when the output terminal 501-3 is active is stored.

The reading of the display data to the shift register A 100 is executed when the display data read signal 508 is at "H" level. Further, this data is maintained as it is while the shift clock mask signal 104 is at "L" level because the shift clock signal 106 is masked. While the shift clock mask signal 104 is at "H" level, the shift clock signal 106 is supplied to the shift registers A 100 and B 101. The serial transfer of the content of the shift register A 100 to the shift register B 101 through the serial data signal 102 is synchronized with the rising of the shift clock signal 106 and the transfer is finished at the eighth rising of the shift clock signal transfer.

The reading of the display data from the shift register B 101 to the display data latch 506 is executed when the display data read signal 508 is at "H" level and its content is simultaneously outputted to the display segment signal output terminal 503 through the high breakdown voltage buffer 513.

Figure 3:
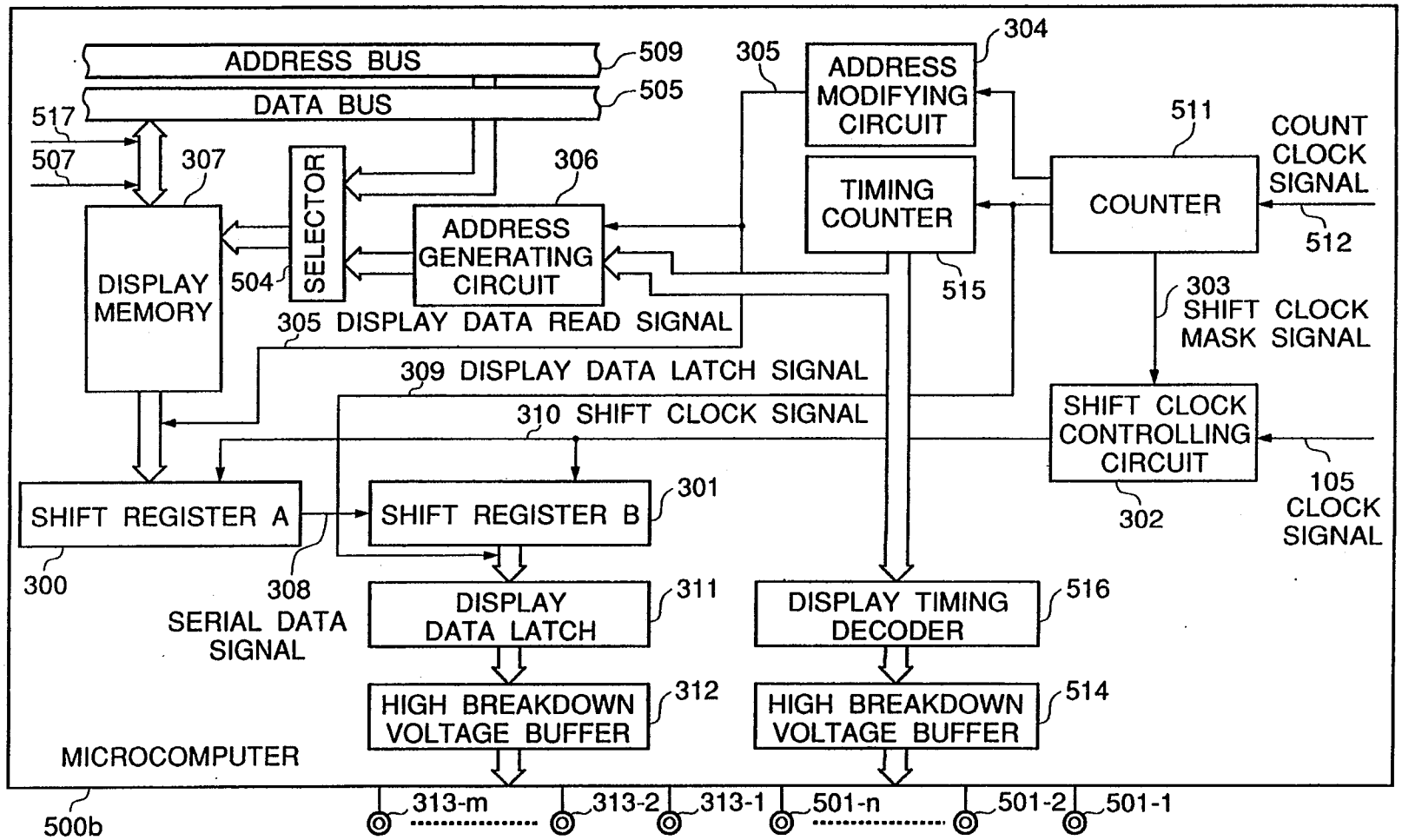
FIG. 3 is a block diagram illustrating a second embodiment of the display controller in accordance with the present invention.
Figure 4:
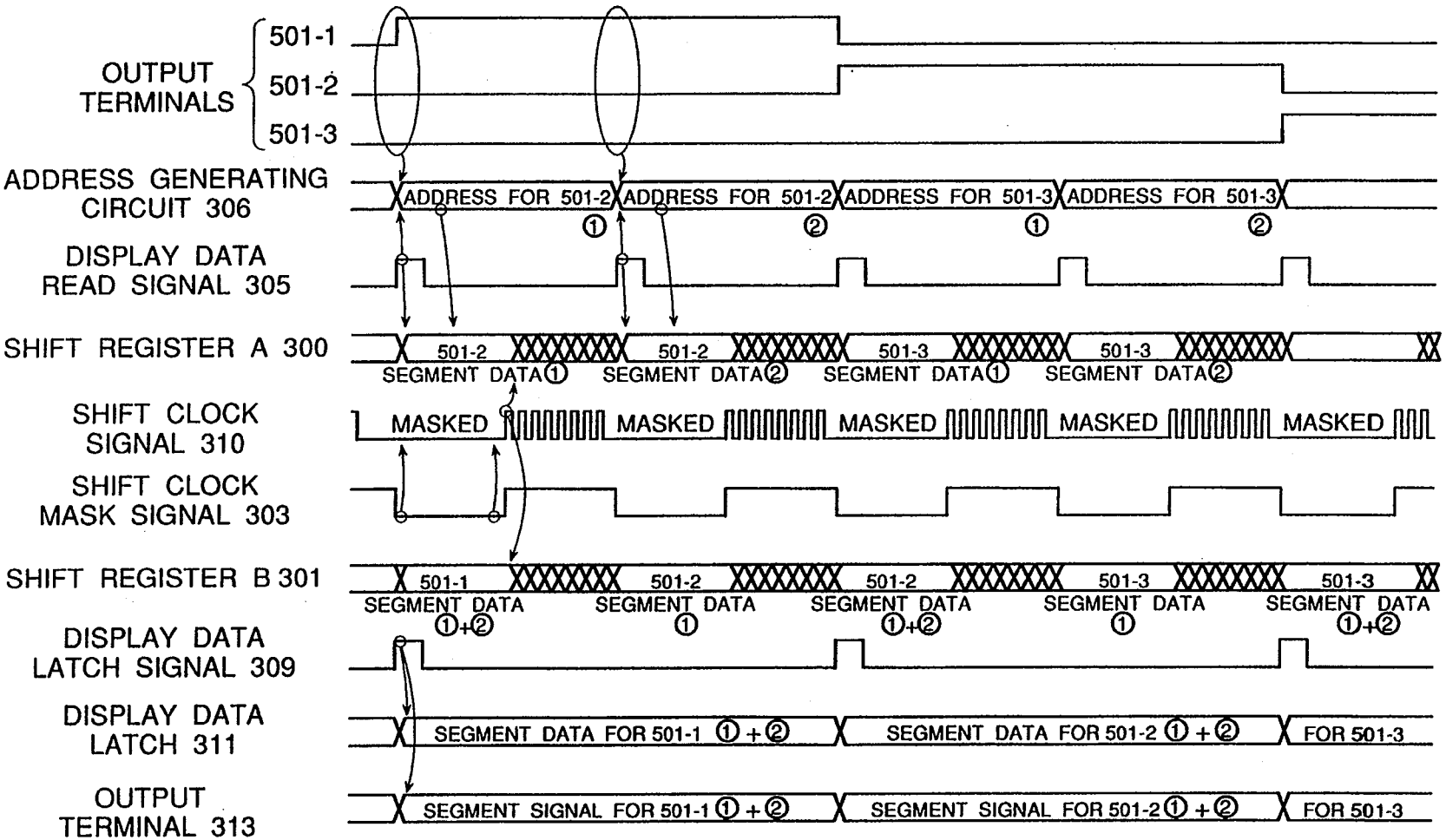
FIG. 4 is a timing chart of the display controller shown in FIG. 3.

FIG. 3 is a block diagram illustrating the second embodiment of the present invention and FIG. 4 is a timing chart illustrating the display output timing. In this second embodiment, the bit length of the shift register B 301 and the display data latch 311 is 16 bits, twice of the shift register A 300, differently from the first embodiment. Namely, this is the case having a larger number of the display segment output lines.

A microcomputer **500*b* of the second embodiment is identical to that of the first embodiment except additionally comprising a address modifying or updating circuit 304. In FIG. 3, a first shift register A 300, a second shift register B 301, a shift clock controlling circuit 302, a shift clock mask signal 303, a display data read signal 305, an address generating circuit 306, a display memory 307, a serial data signal 308, a display data latch signal 309, a shift clock signal 310, a display data latch 311, a high breakdown voltage buffer 312 and display segment signal output terminals 313 (313-1 to 313-*m***) are shown.

The operation of the second embodiment will be described.

According to the second embodiment, a reading from the display memory 307 to the register A 300 in byte units, and a serial transfer from the shift register A 300 to the shift register B 301 are executed twice in the course of the output of the display digit in one digit. Further, The display data of 2 bytes transferred serially to the shift register B 301 is outputted to the data latch 311 once in the course of the output of the display digit in one digit. Simultaneously, it is outputted to the display segment signal output terminals 313 through the high breakdown voltage buffer 312.

The address modifying circuit 304 generates a display data read signal 305. The display data read signal 305 is a signal for reading the display data from the display memory 307 to the shift register A 300. It is also inputted to the address generating circuit 306 and used for updating an address with respect to the display memory 307 with an output from the timing counter 515. The display data read signal 305 is a "H" activated signal and outputted twice with the updating of addresses of the display memory 307 in the course of the output of the display digit in one digit.

Further, after reading the shift register A 300, its content is transferred serially in one bit to the shift register B 301, synchronized with the rising of the shift clock signal 310. Thus, the serial transfer is executed twice in the course of the output of the display digit in one digit. The display data latch signal 309 is a signal for reading the content of the shift register B 301 to the display data latch 311 and outputted at the same timing as that of the display data read signal 508 of the first embodiment.

The above mentioned first and second embodiments of the microcomputer is configured to control the fluorescent display tube. The data transfer from the display memory to the output terminals in an LCD (Liquid Crystal Display) controller can be effected in the same manner as that of the above mentioned embodiments. However, a LCD driving voltage controller is added in order to change the level of the external output terminal. Further, the high breakdown voltage buffers 513 and 514 are substituted with a segment driver and a common driver controlled by the LCD driving voltage controller, respectively.

Figure 5:
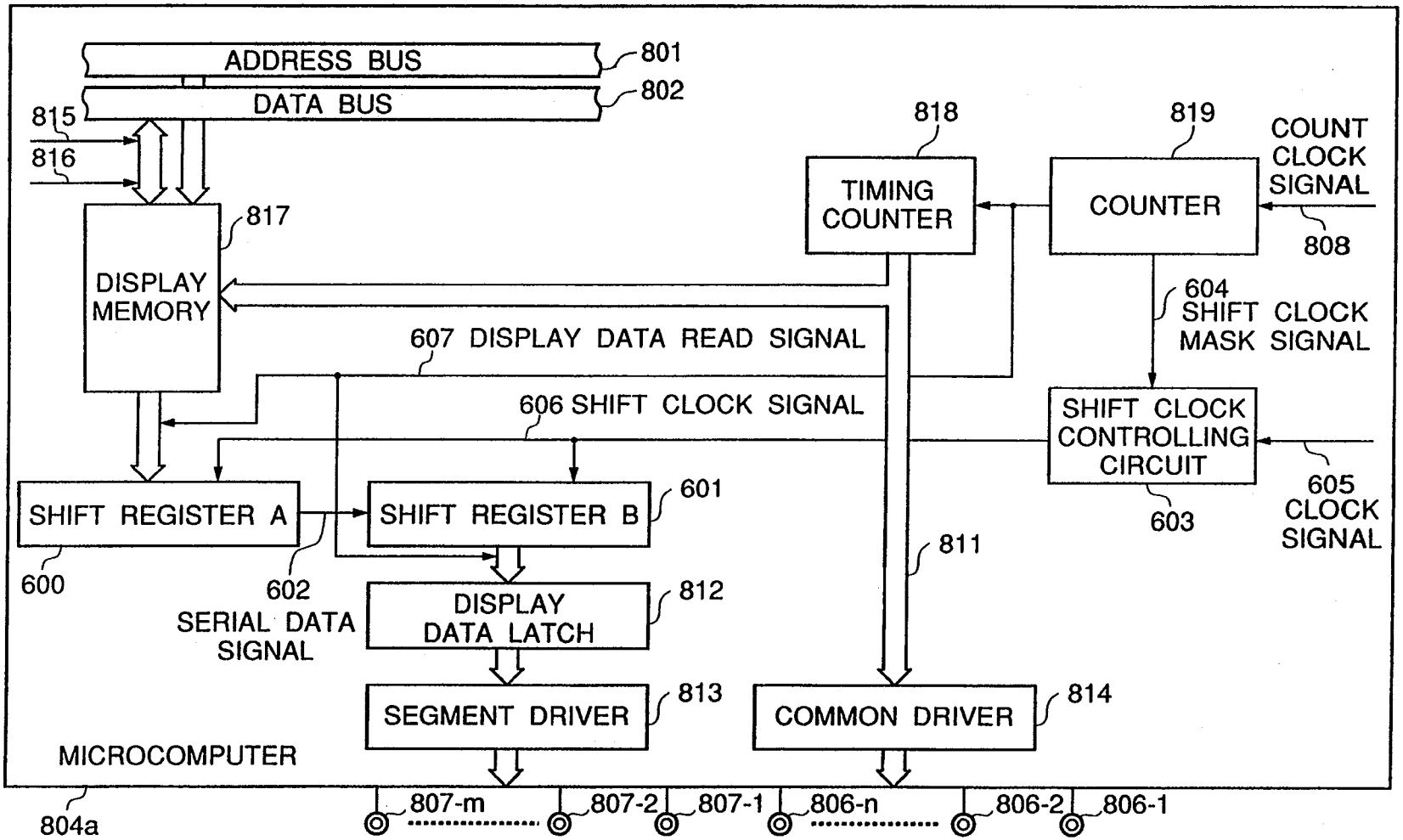
FIG. 5 is a block diagram illustrating a third embodiment of the display controller in accordance with the present invention.
Figure 6:
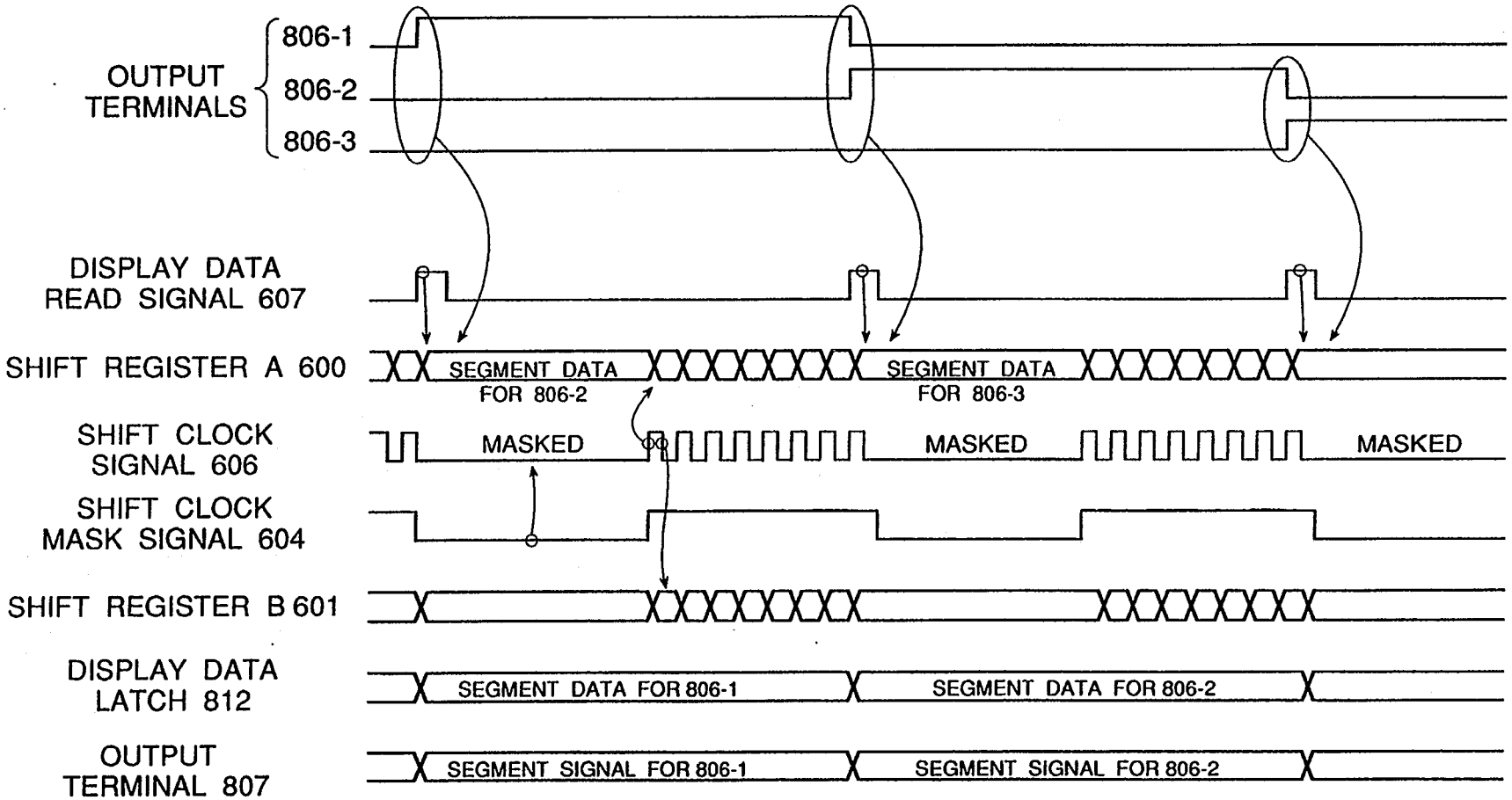
FIG. 6 is a timing chart of the display controller shown in FIG. 5.

Referring to FIG. 5, there is shown a block diagram illustrating the third embodiment of the present invention configured to control an LCD (Liquid Crystal Display) by dynamic driving. FIG. 6 is a timing chart illustrating the timing of the display output.

A microcomputer 804*a* of the third embodiment comprises a first shift register A 600, a second shift register B 601 and a shift clock controlling circuit 603 as data transferring means, which are characteristic of the present invention.

In FIG. 5, a serial data signal 602, a shift clock signal 605, an address bus 801, a data bus 802, common signal output terminals 806 (806-1 to 806-*n*), display segment signal output terminals 807(807-1 to 807-*m*), a count clock signal 808, a display data latch 812, a segment driver 813, a common driver 814, a memory read signal 815, a memory write signal 816, a display memory 817 and a timing controlling circuit 818.

The operation of third embodiment will be described. For the simplicity of the description, the display segment signal output terminal 807 is assumed to be eight lines.

The shift clock controlling circuit 603 outputs the clock signal 605 as shift clock signal 606 and masks a shift clock signal 606 at "L" level for a given time on the basis of a shift clock mask signal 604 outputted from a counter 819. A shift register A 600 reads out the display data stored in the display memory 817 in byte unit in accordance with a display data read signal 607 and executes the serial transfer, one bit by one bit, on the basis of the shift clock signal 606 outputted from the shift clock controlling circuit 603. The display data transferred serially from the shift register A 600 is inputted, one bit by one bit, to the shift register B 601, register having the same bit length as that of the shift register A 600, on the basis of the shift clock signal 606 outputted from the shift clock controlling circuit 603. Then, after the serial transfer, its content is outputted to the display data latch 812 in accordance with the display data read signal 607, and further and simultaneously outputted to a plurality of display segment signal output terminals through the segment driver 813.

The display output timing will be described with reference to FIG. 6.

Output terminals 806-1, 806-2 and 806-3 are outputs of the common signal output terminals 806. The common output terminal 806 outputs a select level successively in order of output terminals 806-1, 806-2 and 806-3, while a timing controlling circuit 818 counts up the common signals. In this embodiment, the select level and the non-select level is are represented by "H" and "L", respectively.

The timing controlling circuit 818 generates a select timing of the common signal to be inputted to the display memory 817. In the third embodiment, the common signal is not that for the display memory 817 in which the display data corresponding to the active common signal output is stored like as in a conventional example, but that for the display memory 817 in which the display data corresponding to the next common signal is stored. Thus, when the output terminal 806-2 is active, the common signal for the display memory 817 in which the display data to be outputted when the output terminal 806-3 is active is generated.

The reading of the display data to the shift register A 600 is executed when the display data read signal 607 is at "H" level. While the shift clock mask signal 604 is at "L" level, this data maintained as it is because the shift clock signal 606 is masked. While the shift clock mask signal 604 is at "H" level, the shift clock signal 606 is suppplied to the shift register A 600 and the shift register B 601 and the serial transfer of the content of the shift register A 600 from the shift register B 601 is executed through the serial data signal 602, synchronized with the rising of the shift clock signal 606 and the transfer is achieved at the eighth rising of the shift clock signal 606.

The reading of the display data from the shift register B 601 to the display data latch 812 is executed when the display data read signal 607 is at "H" level and its content is outputted to the display segment signal output terminal 807 through the segment driver 813.

Figure 7:
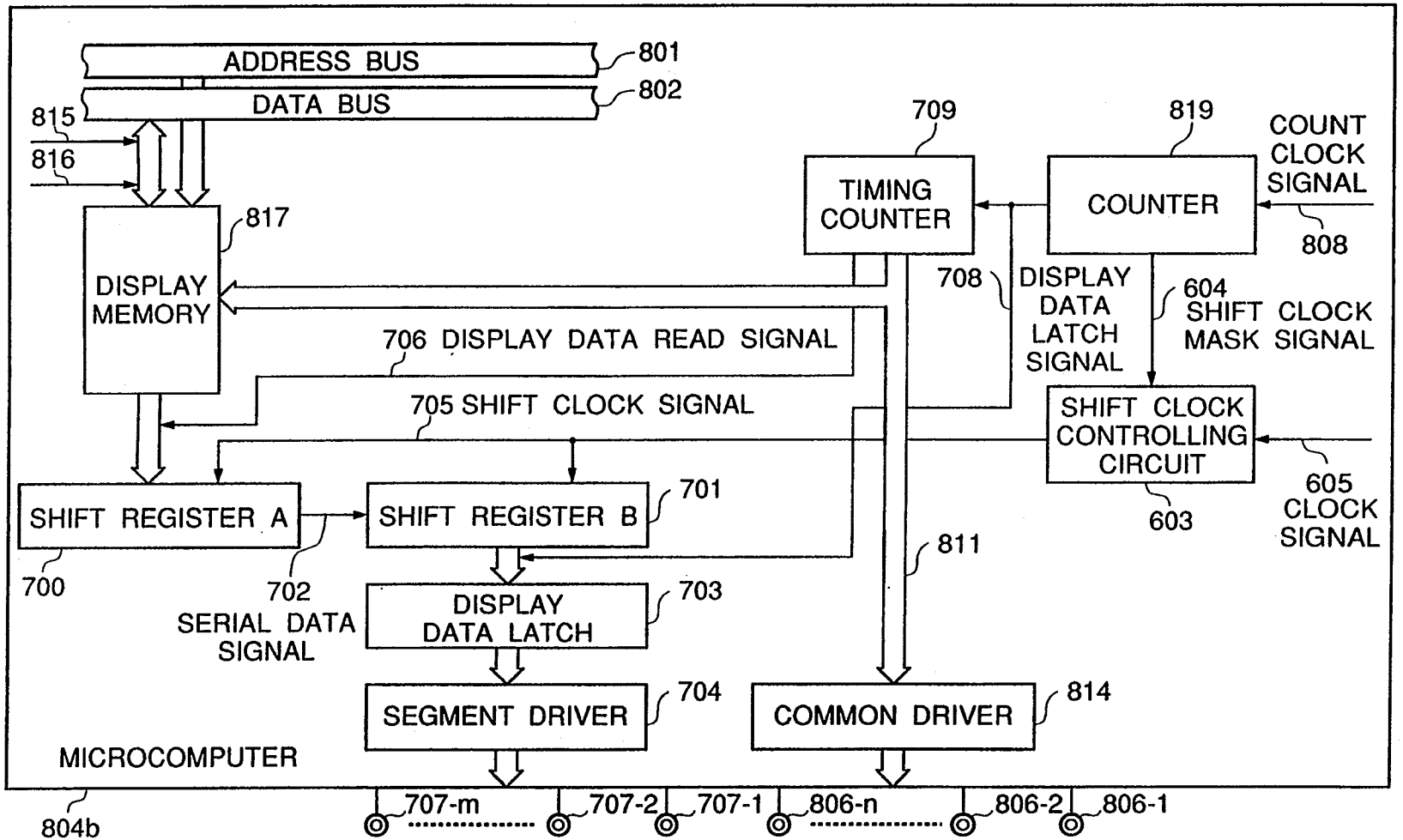
FIG. 7 is a block diagram illustrating a fourth embodiment of the display controller in accordance with the present invention.
Figure 8:
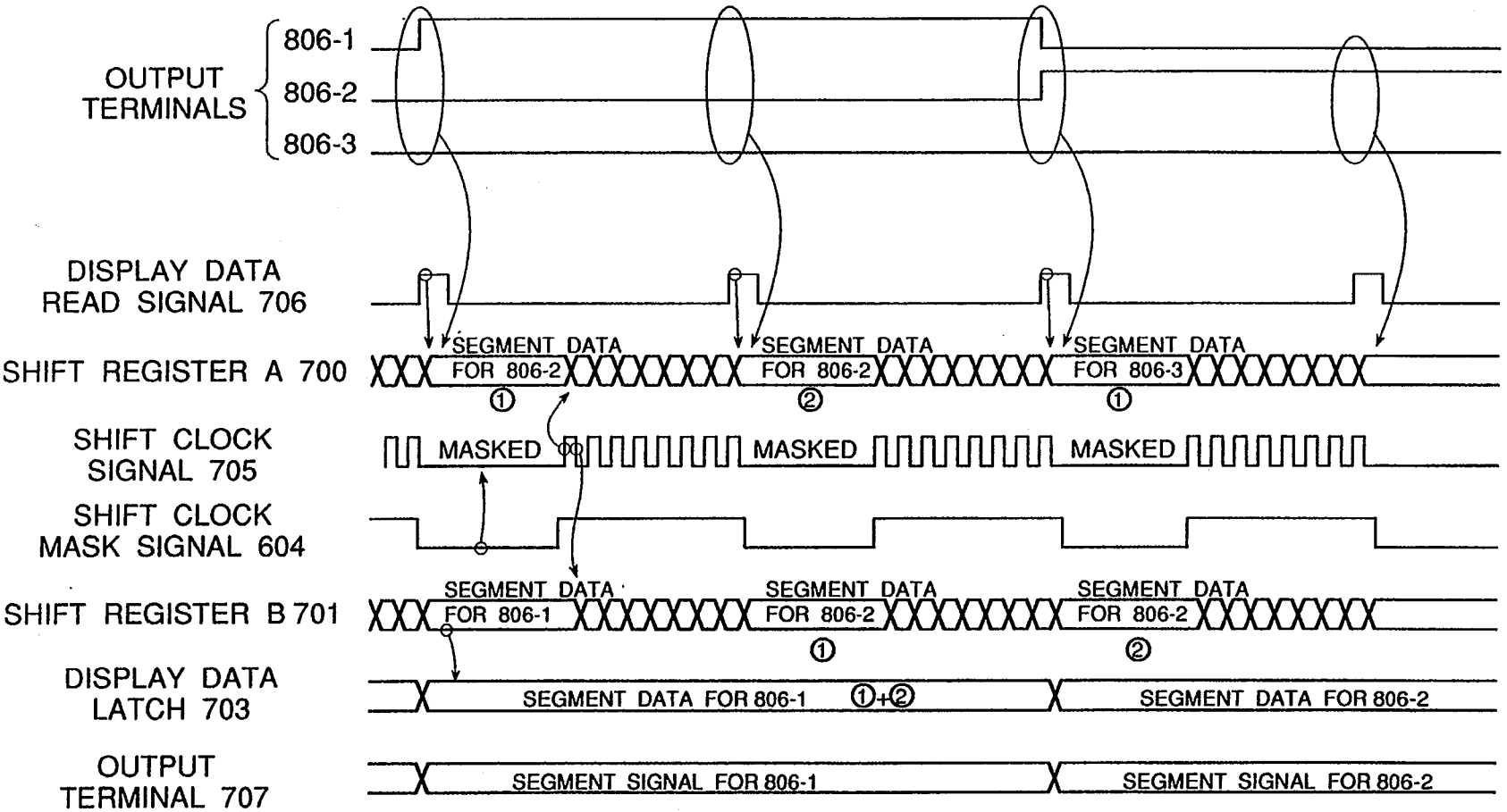
FIG. 8 is a timing chart of the display controller shown in FIG. 7.

FIG. 7 is a block diagram illustrating the fourth embodiment and FIG. 8 is a timing chart illustrating the display output timing. In this fourth embodiment, the bit length of the shift register B701 and the display data latch 703 is 16 bits, twice of the shift register A700, differently from the third embodiment shown in FIG. 5. Namely, this is the case having a larger number of the display segment output lines.

A microcomputer 804*b* of the fourth embodiment differs from that of the third embodiment shown in FIG. 5 in that a counter 819 outputs a display data latch signal to the shift register B 701 and that a timing controlling circuit 709 outputs a display data signal 709 to a display memory 817.

In FIG. 7, a first shift register A 700, a serial data signal 702, a display data latch 703, a segment driver 704, a shift clock signal 705 and display segment signal output terminals 707 (707-1 to 707-*m*) are shown.

Next, the operation of the fourth embodiment will be described.

In the fourth embodiment, the reading from the display memory 817 to the shift register A 700 and the serial transfer from the shift register A 700 to the register B 701 are executed twice in the course of selecting a common. Further, the display data of two bytes transferred serially to the shift register B 701 is outputted to the display data latch 703 in the course of selecting a common and simultaneously to the display segment signal output terminal 707 through the segment driver 704.

A display data read signal is a signal for reading out the display data from the display memory 817 to the shift register A 700 and used for updating in common with respect to the display memory 817 with an output of the timing controlling circuit 709. A display data read signal 706 is a "H" active signal and outputted twice in the course of selecting a common, synchronized with the updating of the address of the display memory 817. Further, after reading to the shift register A 700, the content is transferred serially in unit of one bit, synchronized with the rising of the shift clock signal 705. Thus, the serial transfer is executed twice in the course of selecting a common.

A display data latch signal 708 is a signal for reading out the content of the shift register B 701 to the display data latch 703 and outputted at the same timing as that of the display data read signal 607 of the third embodiment.

Figure 9:
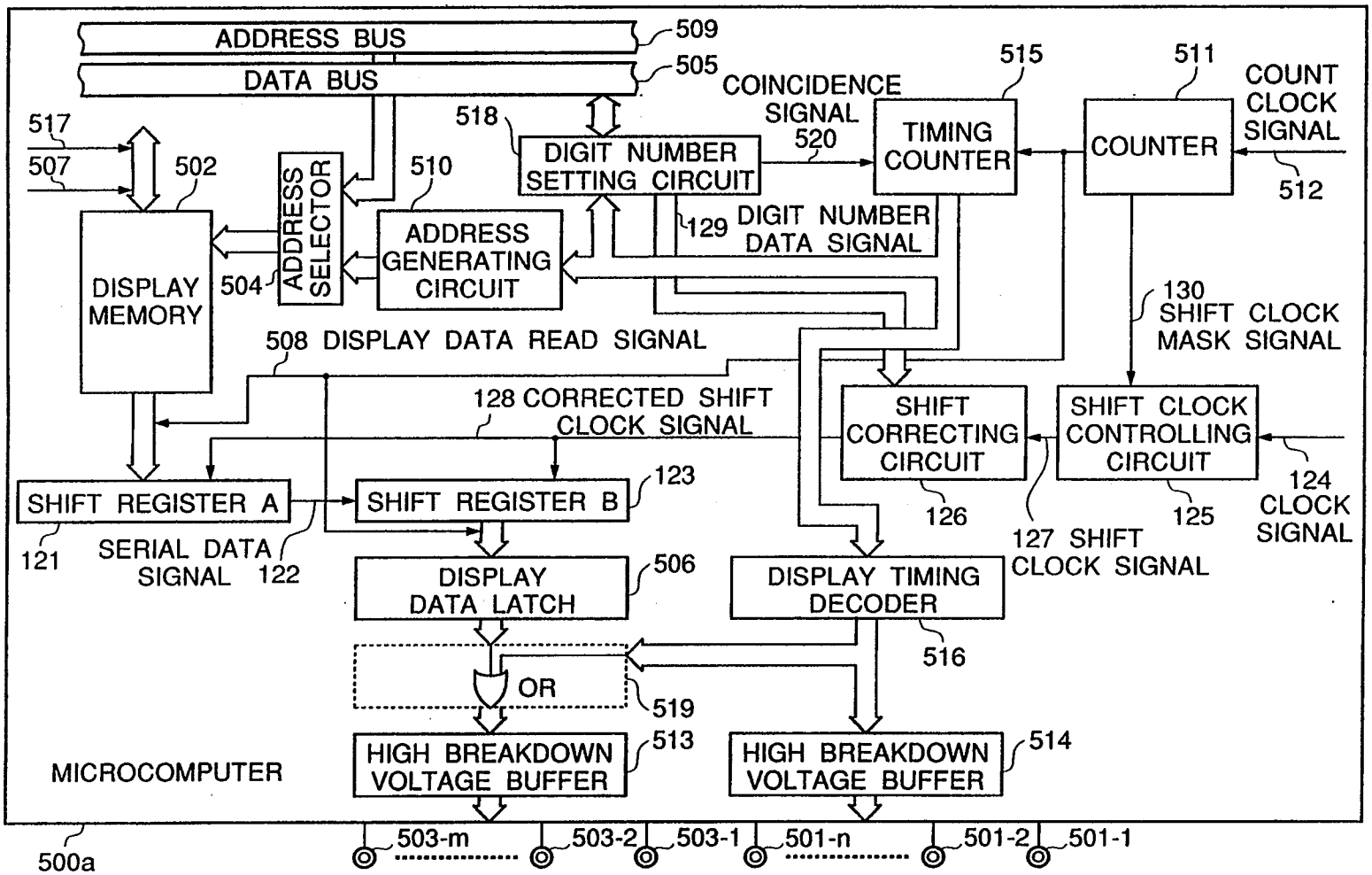
FIG. 9 is a block diagram illustrating a fifth embodiment of the display controller in accordance with the present invention.

FIG. 9 is a block diagram of a fifth embodiment illustrating a fluorescent display tube controller. In FIG. 9, elements corresponding to those shown in FIG. 1 are given the same Reference Numerals, and explanation thereof will be omitted as a general rule.

A microcomputer 500*a* of the fifth embodiment comprises a display controller consisting of a display memory 502 for storing a display data, a digit-setting circuit 518 which can be set with a display digit, a display timing decoder 516 for outputting a display digit signal, a display data latch 506 for latching and outputting the display data read out from the display memory 502 and a plurality of display segment and digit signal output terminals 503 (503-l to 503-*m*) for outputting the output of the display timing decoder 516 and the display data latch 506 to the exterior. The microcomputer 500*a* also comprises a first shift A 121 of a plurality of bits for reading the display data, storing and outputting it serially, a second shift register B 123 of a plurality of bits for storing the display data outputted from the shift register A 121 and outputting it to the display data latch 506 in parallel, a shift clock controlling circuit 125 for generating a shift clock signal 127 which permits the first and second shift register A 121 and B 123 to shift-function and a shift correcting circuit 128 for controlling the generated shift clock signal 128 in accordance with a value of the digit-setting circuit 126.

In FIG. 9, a plurality of diaplay digit signal output terminals 501 (501-l to 501-*n*), an address selector 504, a data bus 505, a memory write signal 507, a display data read signal 508, an address bus 509, an address generating circuit 510, a counter 511, a count clock signal 512, high breakdown voltage 513 and 514, a timing counter 515, a display timing decoder 516 and a memory read signal 517 are shown.

The digit number setting value circuit 518 stores a display digit number and compares the set display digit number with a count value of the timing counter 515 When they coincide to each other, the circuit 518 outputs the coincidence signal 520 to the timing counter 515.

The display timing decoder 516 decodes the count value outputted from the timing counter 515, generates the display digit signal and then outputs a "H" active signal successively from the plurality of display digit signal output terminals 501 through the high breakdown voltage buffer 514. Further, in the case that the digit number set in the digit setting circuit 518 is larger than the number of the display digit signal output terminals, the overflown digit signal output signal is outputted from an output of the display timing decoder 516 to the display segment and digit signal output terminals 503 through an OR circuit 519 and the high-breakdown voltage circuit 513.

The address generating circuit 510, which outputs an address to be updated with counting up of the timing counter 515 generates an address to read out the display data of the display memory 502 corresponding to the respective activated display digit signal. The display data latch 506 consists of 2 stages, that is, master-slave. The latch 506 receives the data of a plurality of bits in parallel when the display data read signal 508 is at "H" level. When the signal 508 becomes at "L" level, the received data is transferred from the master to the slave and its content is outputted from the slave to the a plurality of segment-digit signal output terminals through the high breakdown voltage buffer 513. The maximal value of the segment number of the display data depends on the display digit number and among the display segment-digit number output terminals 503, only the terminals which are not used for the output of the display digit signal can be used for the output of the display segment terminal 503.

Next, the operation of the fifth embodiment will be described.

In the present fifth embodiment, the width of the display data is 5 bits, the display digit signal output terminals 501 are eight (501-1 to 501-8) and the display segment signal output terminals 503 are eight (503-1 to 503-8) for the simplicity of the explanation.

The shift clock controlling circuit 103 outputs a clock signal 105 as shift clock signal 106 and masks the shift clock signal 106 at "L" level for a given period on the basis of a shift clock mask signal 104.

The shift clock generating circuit 125 generates a shift clock signal 127 from a shift clock signal 124 and also masks the clock signal 124 at "L" level for a given period in accordance with the shift clock signal 127 outputted from the counter 511. While the shift clock signal 127 is masked at "L" level, a display data is read out from the display memory 502.

A display digit number previously set in the digit number setting circuit is sent to the shift correcting circuit 126 as a digit number data signal 129. The shift correcting circuit 126 finds out the real shift clock number for the digit number data signal 129. The real shift clock number is given by a following formula; {(number of the display segment and digit signal output terminals 503+number of the display digit signal output terminals 501)−display digit number}. In this case, the real shift clock number is $\{(8+8)-11\}=5$. The shift clock correcting circuit 126 masks the shift clock signal 127 which will be a criteria of the output of the shift clock generating circuit 125 and outputs it to the shift registers A 121 and B 123.

In the digit number setting circuit 518, a display digit number is previously set through the data bus 505 by a command. In this case, "11" is set. As mentioned above, this value is outputted to the shift correcting circuit 126 as a digit number value. Further, the digit number setting circuit 518 compares the set digit number with a value of the timing counter 515 in the interior and outputs a coincidence signal 520 to the timing counter 515 when they coincides with each other.

A display data having a width of 5 bits read out from the display memory 502 and stored in the shift register A 121 is transferred to the shift register B 123 as serial data signal in accordance with five correcting shift clock signals 128. Then the display data having a width of 5 bits, outputted from the shift register B 123 to the display data latch 506 in accordance with the display data read signal 508, is outputted through an OR circuit 519 and a high-breakdown voltage circuit 513 form the outputs 503-4 to 503-8 of the display segment-digit signal output terminals 503.

Further, the shift register B 123 is cleared to "00" in accordance with a display data read signal 508 in order to prepare the next data transfer. On the other hand, the timing counter 515 counts from the first digit. When it counts to the digit number set in the digit number setting circuit 518, that is, "11", the counter 511 returns to the initial value and then the counting is started form the first digit.

The timing decoder 516 outputs a display digit signal through the high breakdown voltage buffer 514 to the display digit signal output terminal 501 in accordance with an output of the timing counter 515. In this case, the display digit signal is outputted in the order of 501-1, 501-2 and 501-3 and the display digit signal of the ninth digit is outputted from the timing decoder 516 through the OR circuit 519 and the high-breakdown voltage buffer 513 to the display segment-digit signal output terminal 503-1. The display digit signals of the tenth and eleventh digits are also outputted to the output terminals 503-2 and 503-3.

Figure 10:
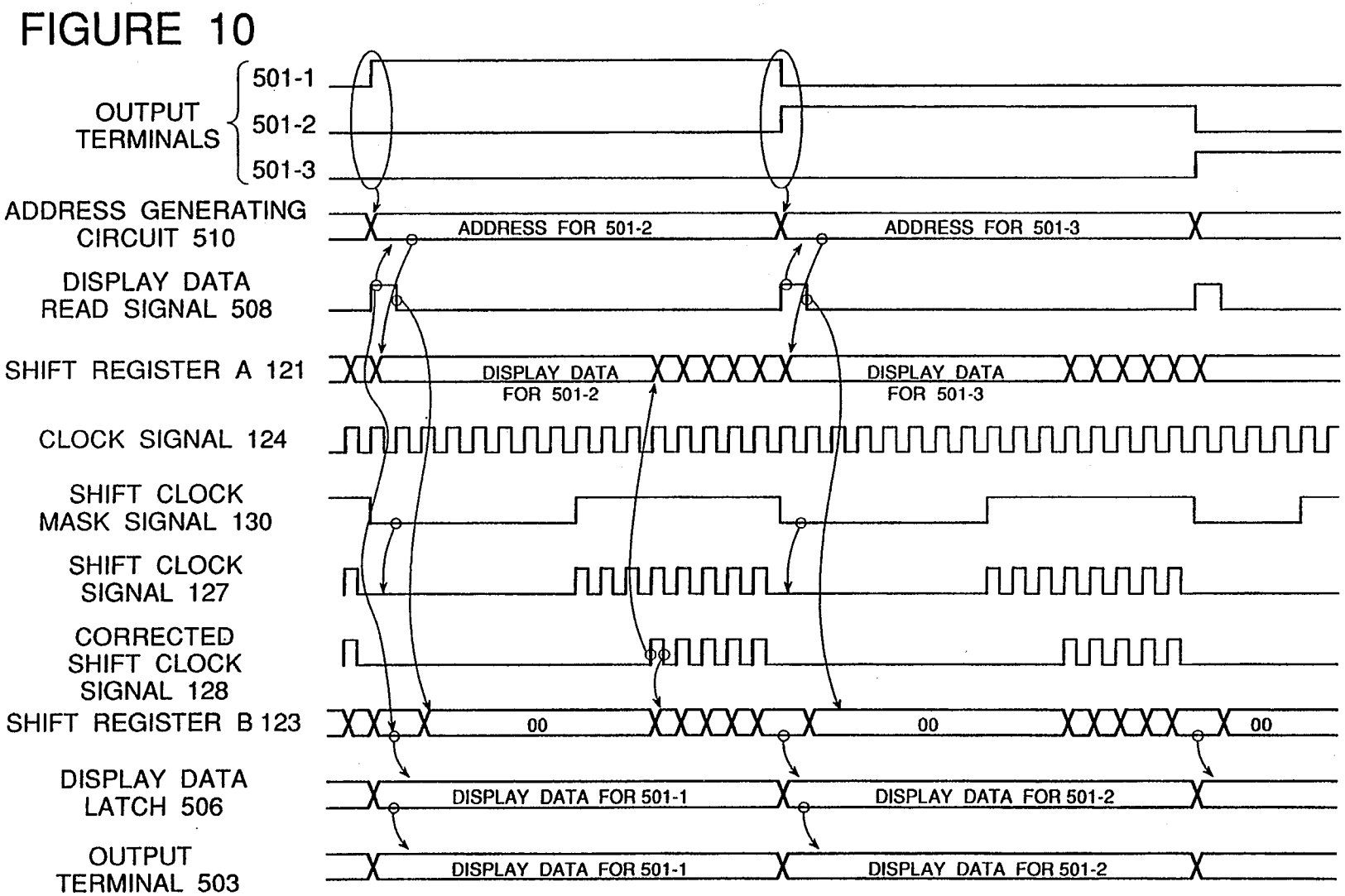
FIG. 10 is a timing chart of the display controller shown in FIG. 9.

Then, the display digit timing of the fifth embodiment will be explained with reference to FIG. 10. In FIG. 10, the output terminals 501-1, 501-2 and 501-3 are outputs of the display digit signal output terminals 501. The display digit signal output terminal 501 outputs the "H" active signals in the order of the output terminals 501-1, 501-2 and 501-3 when the timing decoder 515 counts up the display digits.

An address of the display memory 502 generated by the address generating circuit 510 is updated simultaneously with the count up of the timing decoder 502. Thus, when the output terminal 501-2 is active, the address generating circuit 510 generates an address of the display memory 502 in which the display data to be outputted when the output terminal 501-3 is active is stored.

The reading of the display data from the shift register A 121 is executed when the display data read signal 508 is at "H" level. Further, a shift clock signal 127 of which the clock is masked for a given period by a shift clock mask signal 130 is masked by the shift correcting circuit and outputted as correcting shift clock signal 128 to the shift registers A 121 and B 123. The content of the shift register A 121 is transferred as serial data signal 122 to the shift register B 123, synchronized with the rising of the correcting shift clock signal 128 and the transfer is finished at the fifth rising of the correcting shift clock signal 128.

The reading of the display data from the shift register B 123 to the display data latch 506 is executed when the display data read signal 508 is at "H" level and simultaneously its content is outputted to the display segment-digit signal output terminal 503.

Figure 11:
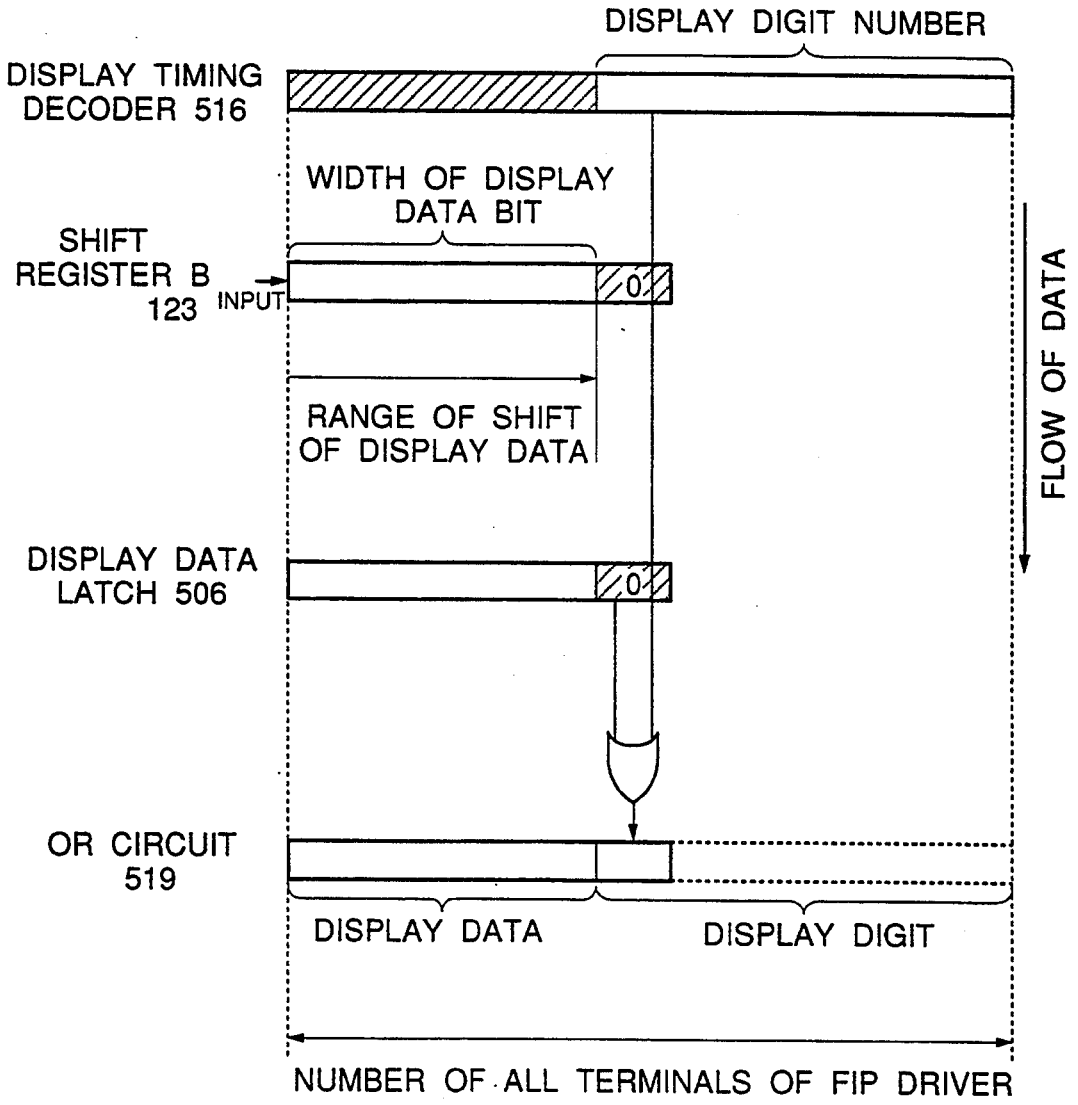
FIG. 11 illustrates the function of the display controller shown in FIG. 9.

FIG. 11 shows an extract of the display data part and the display digit part of the fifth embodiment for the simplicity of the explanation. In FIG. 11, the respective bit location corresponds to the longitudinal direction and the data is transferred downward.

The display digit number is previously set in the digit number setting circuit 518 and the the display digit number of the display timing decoder 516 depends on the set value. Thus, the clock number of the correcting shift clock signal to be outputted from the shift correcting circuit 126 is determined. The display data is transferred serially to the shift register B 123 which is cleared to "00" with the falling of the display data latch.(the data is shift-inputted from the left of the shift register B 123) and the transferred display data is stored in the display data latch 506. As the result, the logical sum of the output of the display data latch 506 and that pf the display timing decoder 516 is obtained in the OR circuit 519 and among bits corresponding to the display segment-d-g-t signal output terminals 503, the bits which are not designated for the output of the display digit signal is used for the output terminals of the display data.

Figure 12:
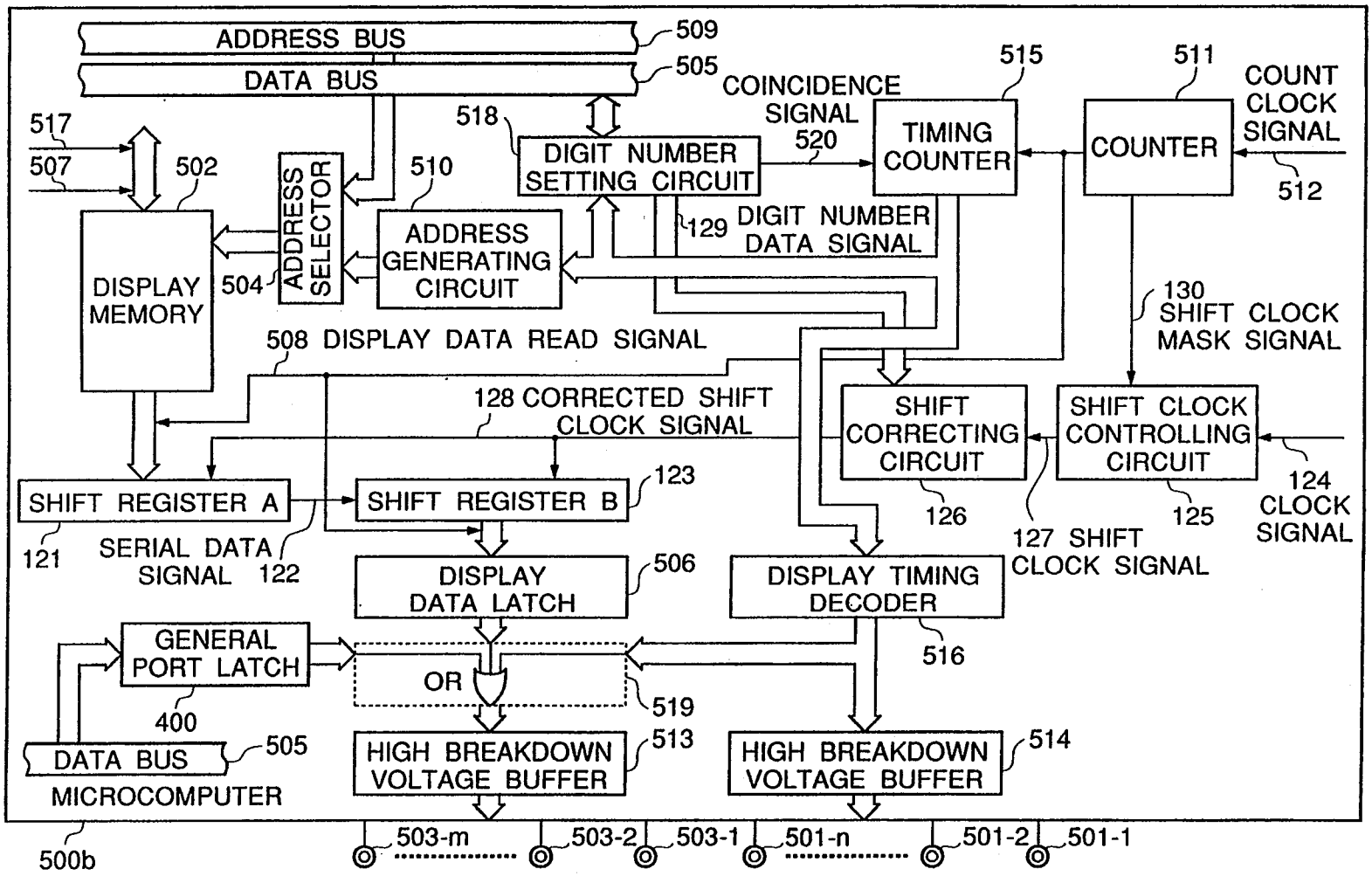
FIG. 12 is a block diagram illustrating a sixth embodiment of the display controller in accordance with the present invention.

FIG. 12 is a block diagram illustrating the sixth embodiment of the fluorescent display tube controller according to the present invention A microcomputer **500*b* of the sixth embodiment is identical to that of the fifth embodiment except comprising a general port latch 400. In the fifth embodiment mentioned above, the clock number of the correcting shift clock signal 128 is determined in accordance with the set display digit value and so the data other than the display data to be displayed at its timing in the display memory 502 is outputted from the display segment digit signal output terminals 503 when the display segment number is small. If data to be outputted is written in the display memory 502 by using these principles, a digit signal corresponding to the address can be outputted at a timing when it becomes active. However, in this case, the output timing depends on the count timing of the timing counter 515. In the sixth embodiment, the general port is added, which permits it to output always from the display segment and digit signal output terminal 503 without depending on the timing count of the timing counter 515**.

When the data to be outputted is written through the data bus 505 to the general port latch 400, it is outputted to the display segment digit output terminal 503 through the OR circuit 519 and the high-breakdown voltage buffer 503.

Figure 13:
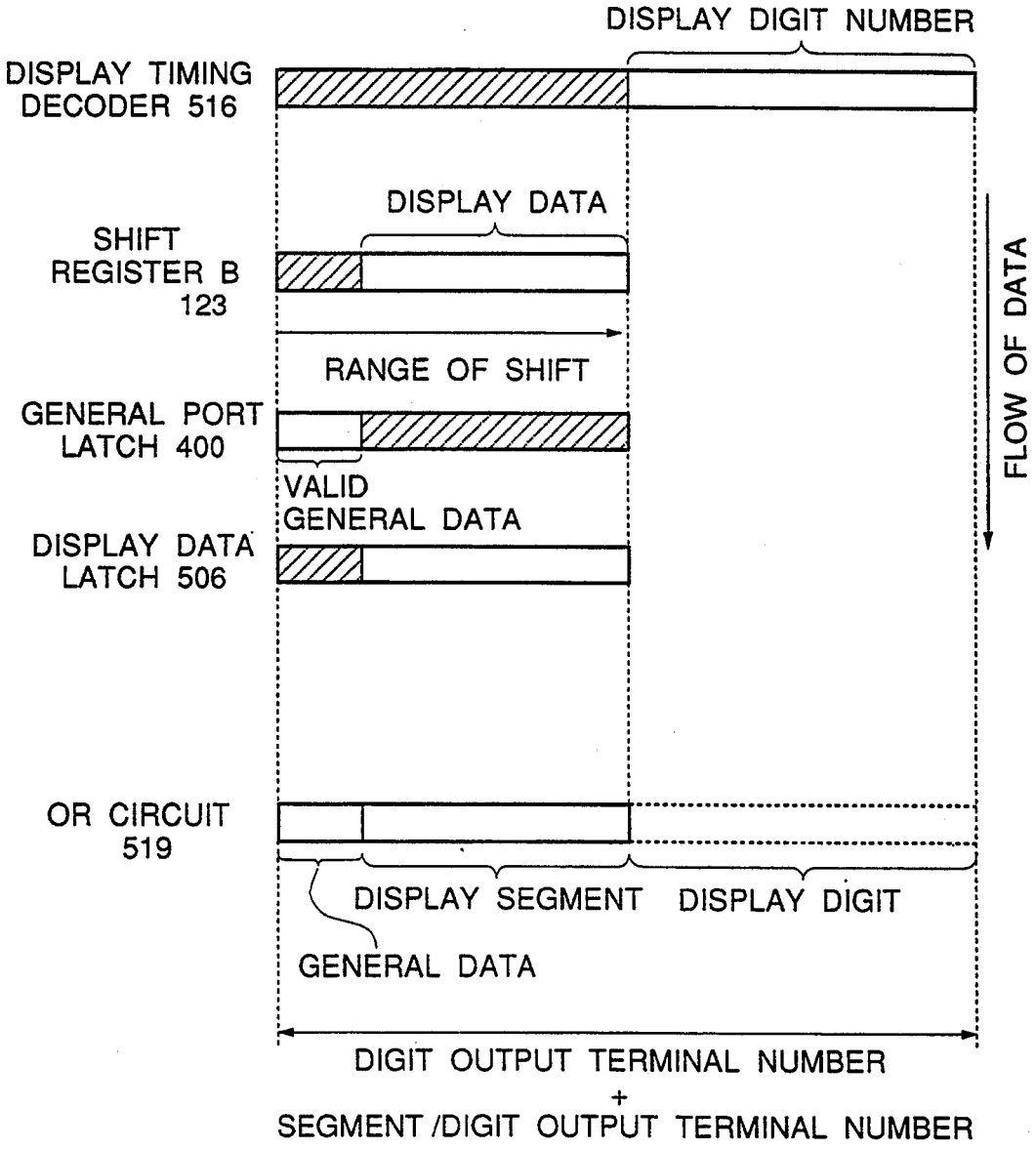
FIG. 13 illustrates the function of the display controller shown in FIG. 9.

FIG. 13 shows an extract of the display data part and the display digit part of fifth embodiment for the simplicity of the explanation. In FIG. 13, the respective bit location corresponds to the longitudinal direction and the data is transferred downward.

The display digit number is previously set in the digit number setting circuit 518 and the the display digit number of the display timing decoder 516 depends on the set value. Thus, the clock number of the correcting shift clock signal 128 to be outputted from the shift correcting circuit 126 is determined. The display data is transferred serially to the shift register B 123 (the data is shift-inputted from the left of the shift register B) and the transferred display data is stored in the display data latch 506. As the result, the logical sum of the output of the display data latch 506 and that of the display timing decoder 516 is obtained in the OR circuit 519 and among bits corresponding to the display segment-d-g-t signal output terminals 503, the bits which are not designated for the output of the display digit signal is used for the output terminals of the display data.

However, in the sixth embodiment, only the logical sum of the data outputted from the display segment digit signal output terminals 503 is obtained at the OR circuit 519. In this case, among the data transferred serially to the shift register B 123, bits other than the display data, namely, the bits of the data outputted from the general port latch 400 and the bits to obtain the logical sum must be set at "0".

The operation timing of the entire circuit is same as that of the fifth embodiment shown in FIG. 10.

As mentioned above, the display controller in accordance with the present invention comprises a first shift register, a second shift register, a clock signal, a shift clock controlling circuit, a shift clock mask signal, a shift clock signal and a serial data signal. Thus, the data transfer from the memory storing the display data from the display data latch can be executed with two lines, that is, a serial data signal line for transferring the display data form the first shift register to the second shift register and a serial clock signal line from the serial clock controlling circuit. Thus, it is possible to reduce the increase of the number of lines accompanying with the increase of the segments as well as the chip surface. And it is also possible to reduce restriction relates to the arrangement of the internal part of the microcomputer.

The invention has thus been shown and described with reference to the specific embodiments. However, it should be noted that the present invention is in no way limited to the details of the illustrated structures but changes and modifications may be made within the scope of the appended claims.

We claim:

1. A display controller contained in a microcomputer, said display controller being fabricated on a chip and comprising:

a display memory for storing display data, a timing counter for generating a count value output, an address generating circuit responsive to said timing counter for outputting an address to said display memory to select data for reading out of said display memory, a digit-setting circuit which can be set with a display digit number, a display timing decoder responsive to said timing counter for outputting a display digit signal, a first shift register of a plurality of bits for holding display data read out from said display memory, and for serially outputting the held display data, said first shift register being located near said display memory on said chip, a second shift register of a plurality of bits for serially storing the display data outputted from said first shift register and for outputting the stored display data in parallel, a shift clock controlling circuit for generating a shift clock signal to be supplied to said first and second shift registers, a shift correcting circuit receiving said shift clock signal and a value of said digit-setting circuit for controlling said shift clock signal supplied to said first and second shift registers to cause them to shift-operate, a display data latch for latching the display data outputted from said second shift register in parallel and for outputting the latched display data, said second shift register being located near said display data latch on said chip thereby minimizing a number of wiring lines extending between the display memory and the display data latch and decreasing an area of said chip for said display controller, and a plurality of display segments and digit signal output terminals respectively receiving outputs of said latched display data outputted from said display data latch and said display timing decoder for outputting the received data and display digit signal to the exterior of the chip.

2. A display controller claimed in claim 1 wherein said display data latch has an output connected through a high breakdown voltage buffer to said display segment signal output terminals so that the display controller can control a fluorescent display tube and wherein said signal output terminals receiving said count value from said timing counter are display digit output terminals for the fluorescent display tube.

3. A display controller claimed in claim 1 said display data latch has an output connected through a segment driver to said display segment signal output terminals so that the display controller can control a liquid crystal display and wherein said signal output terminals receiving said count value from said timing counter are common signal output terminals for the liquid crystal display.

* * * * *